US008978679B2

(12) United States Patent
Jennings

(10) Patent No.: US 8,978,679 B2
(45) Date of Patent: Mar. 17, 2015

(54) INSTA-GARAGE

(71) Applicant: Joseph Jennings, Sarasota, FL (US)

(72) Inventor: Joseph Jennings, Sarasota, FL (US)

( * ) Notice: Subject to any disclaimer, the term of this patent is extended or adjusted under 35 U.S.C. 154(b) by 47 days.

(21) Appl. No.: 13/862,543

(22) Filed: Apr. 15, 2013

(65) Prior Publication Data

US 2014/0007913 A1 Jan. 9, 2014

Related U.S. Application Data

(60) Provisional application No. 61/669,192, filed on Jul. 9, 2012.

(51) Int. Cl.
*E04H 6/04* (2006.01)
*E04H 15/38* (2006.01)

(52) U.S. Cl.
CPC . *E04H 6/04* (2013.01); *E04H 15/38* (2013.01)
USPC ..... 135/96; 135/88.06; 135/130; 52/63

(58) Field of Classification Search
CPC ..... E04H 6/04; E04H 15/06; E04H 15/38; E04H 15/48; B60P 3/34; B60P 3/341
USPC ..... 135/88.06, 88.13, 129–131, 96, 97, 135/912, 904, 117, 119; 52/63, 69, 79.5, 52/143; 296/161, 163, 165, 24.5
See application file for complete search history.

(56) References Cited

U.S. PATENT DOCUMENTS

| | | | | | |
|---|---|---|---|---|---|
| 3,171,417 | A | * | 3/1965 | Stokes | 135/132 |
| 3,463,174 | A | * | 8/1969 | Heller | 135/143 |
| 4,150,682 | A | * | 4/1979 | Ryce | 135/130 |
| 4,228,622 | A | * | 10/1980 | Tisma | 52/3 |
| 5,275,460 | A | | 1/1994 | Kraus | |
| 5,277,214 | A | * | 1/1994 | Tolley | 135/133 |
| 5,740,826 | A | * | 4/1998 | Nevin et al. | 135/88.06 |
| 5,839,462 | A | * | 11/1998 | Randall | 135/128 |
| 5,845,958 | A | | 12/1998 | Rudys et al. | |
| 5,941,594 | A | | 8/1999 | O'Neill | |
| D424,009 | S | | 5/2000 | McGrew | |
| 6,672,643 | B1 | | 1/2004 | Brodskiy et al. | |
| 7,604,016 | B2 | * | 10/2009 | Songest | 135/132 |

(Continued)

FOREIGN PATENT DOCUMENTS

| | | | | | |
|---|---|---|---|---|---|
| GB | 2354777 | A | * | 4/2001 | E04H 6/04 |
| JP | 09151625 | A | * | 6/1997 | E04H 15/06 |
| JP | 10252301 | A | * | 9/1998 | E04H 6/04 |

*Primary Examiner* — Winnie Yip
(74) *Attorney, Agent, or Firm* — Buckingham, Doolittle & Burroughs, LLC

(57) ABSTRACT

A temporary garage device is disclosed that allows users to easily protect the outside of their vehicle from the elements. The temporary garage device comprises a protective cover component and a storage component for storing the protective cover component. Typically, the protective cover component is positioned in an arc-shape via a plurality of thin beams secured to the interior surface of the protective cover component to form a semi-rigid skeletal structure. Specifically, the protective cover component collapses in an accordion style for storage in the interior of the storage component. When needed, the protective cover component can then be linearly extended outward from the storage component in a semi-tubular configuration to cover the vehicle. Additionally, the storage component can comprise a plurality of wheels secured to a bottom side to allow the storage component to move and for ease in transportation of the temporary garage device.

13 Claims, 5 Drawing Sheets

(56) References Cited

U.S. PATENT DOCUMENTS 7,669,913 B2 3/2010 DaSilva
7,874,304 B2 * 1/2011 Ostrowski ..... 135/148
8,171,947 B2 * 5/2012 Hardie ..... 135/129
2006/0162755 A1 * 7/2006 Platek et al. ..... 135/88.15
2007/0176462 A1 8/2007 Lombardo

* cited by examiner

INSTA-GARAGE

CROSS-REFERENCE

This application claims priority from Provisional Patent Application Ser. No. 61/669,192 filed Jul. 9, 2012.

BACKGROUND

Not all vehicle owners are privileged to have a garage or covered parking space at their home, apartment, or condominium. However, parking a vehicle outdoors and without a cover exposes the vehicle to destructive elements such as sunlight, rain, snow, hail, bird droppings, and other debris. Further, apartment and condominium complexes may or may not offer covered parking spaces for residents, and when they do, the covered parking spaces can be expensive. Houses and other dwellings also may lack proper covered parking facilities for vehicle owners, or the covered parking facility may take up a large amount of space. An effective solution is necessary.

The present invention provides vehicle owners with a proper place to store and protect their vehicles. This temporary garage device assists vehicle owners in preserving their investment in their vehicle, and helps shield the vehicle and other items from harmful elements and harsh weather conditions. Further, when not in use, the temporary garage device stores neatly and does not take up the amount of space that a garage, tent or other covered structure would. Homeowners, condominium-owners, and tenants without garages or access to covered parking would benefit from the convenience and portability this device provides. Further, this temporary garage device is designed to protect cars, trucks, boats, farm implements, garden equipment, motorcycles, motorscooters, bicycles, airplanes, outhouses, and various other structures not otherwise protected from the elements or having access to a permanent garage.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a temporary garage device that allows users to easily protect their vehicle from the elements. The temporary garage device comprises a protective cover component and a storage component for storing the protective cover component when not in use. Typically, the protective cover component is positioned in an arc-shape via a plurality of thin beams secured to the interior surface of the protective cover component to form a semi-rigid skeletal structure. Specifically, the protective cover component collapses in an accordion style for storage in the interior of the storage component when not in use. When needed, the protective cover component can then be linearly extended outward from the storage component in a semi-tubular configuration to cover the vehicle.

In a preferred embodiment, the protective cover component comprises a plurality of securing components, such as magnets to secure the protective cover component to the vehicle. Further, the protective cover component can comprise a pair of handles secured to either side (or both sides) of the arc-shaped protective cover component to allow a user to pull the protective cover component linearly outward from the storage component. Additionally, the storage component can comprise a plurality of wheels secured to a bottom side to allow the storage component to move and for ease in transport of the temporary garage device.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
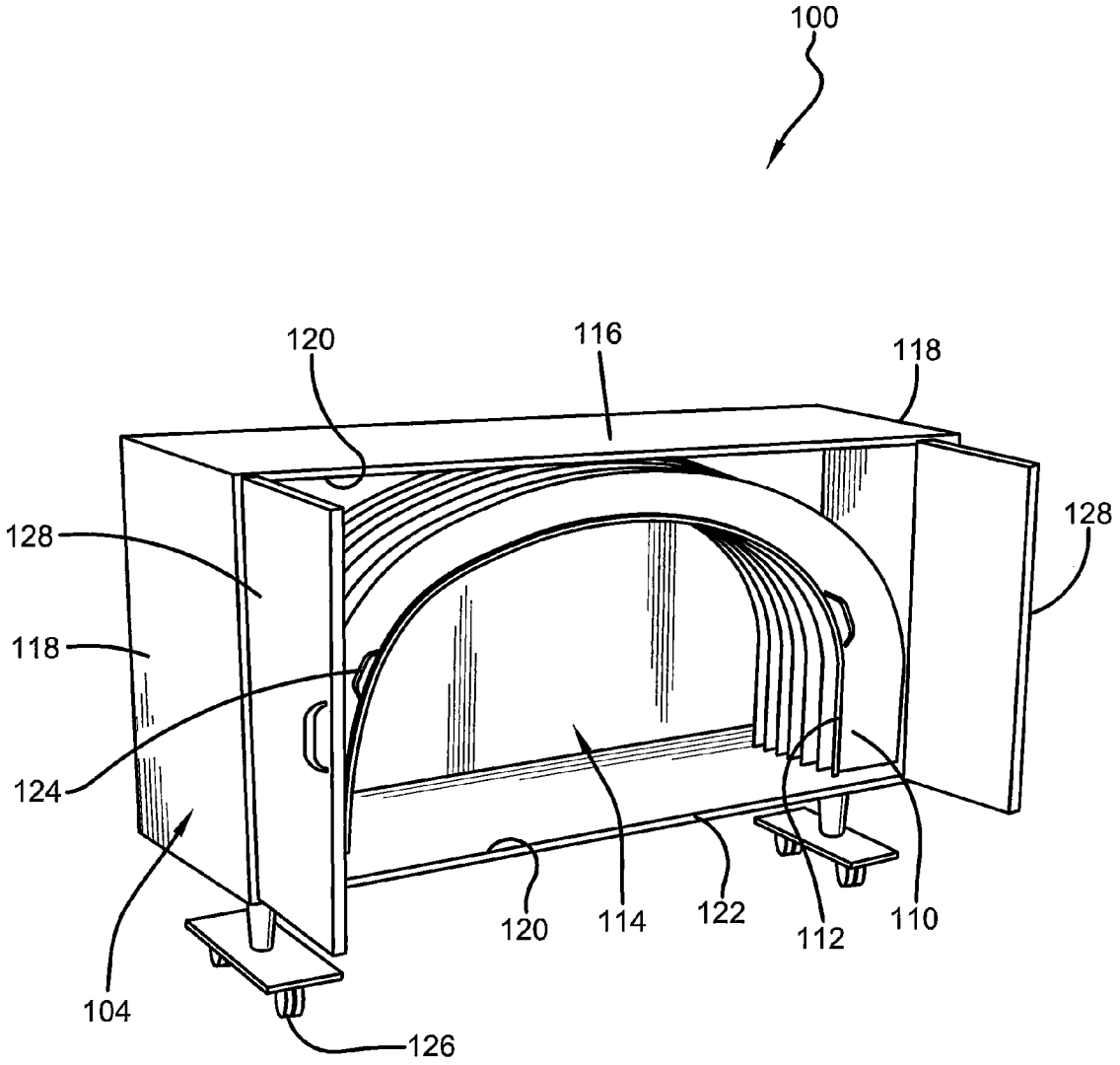
FIG. 1 illustrates a perspective view of the temporary garage device collapsed in the storage component in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a temporary garage device that provides vehicle owners with a proper place to store and protect their vehicles. This temporary garage device assists vehicle owners in preserving the vehicle's investment from harmful elements and harsh weather conditions. Further, when not in use, the temporary garage device stores neatly and does not take up the amount of space that a garage, tent or other covered structure would. Homeowners, condominium-owners, or apartment renters without garages or access to covered parking would benefit from the convenience and portability this device provides.

The temporary garage device comprises a protective cover component and a storage component for storing the protective cover component. Typically, the protective cover component is positioned in an arc-shape via a plurality of thin beams secured to the interior surface of the protective cover component to form a semi-rigid skeletal structure. Specifically, the protective cover component collapses in an accordion style for storage in the interior of the storage component. When needed, the protective cover component can then be linearly extended outward from the storage component in a semi-tubular configuration to cover the vehicle. Additionally, the storage component can comprise a plurality of wheels secured to a bottom side to allow the storage component to move and for ease in transportation of the temporary garage device.

Figure 2:
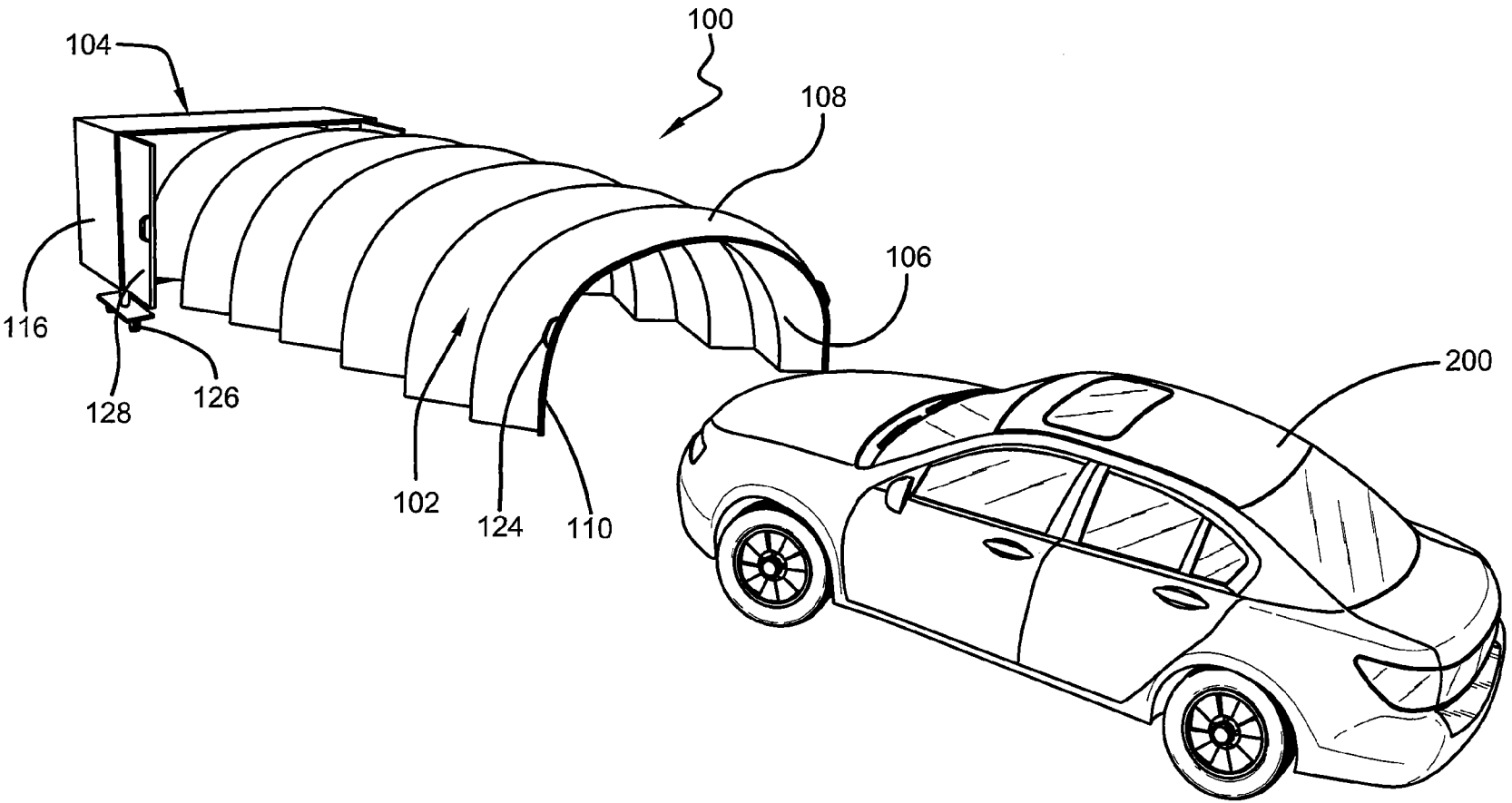
FIG. 2 illustrates a perspective view of the temporary garage device being extended linearly outward to cover a vehicle in accordance with the disclosed architecture.
Figure 3:
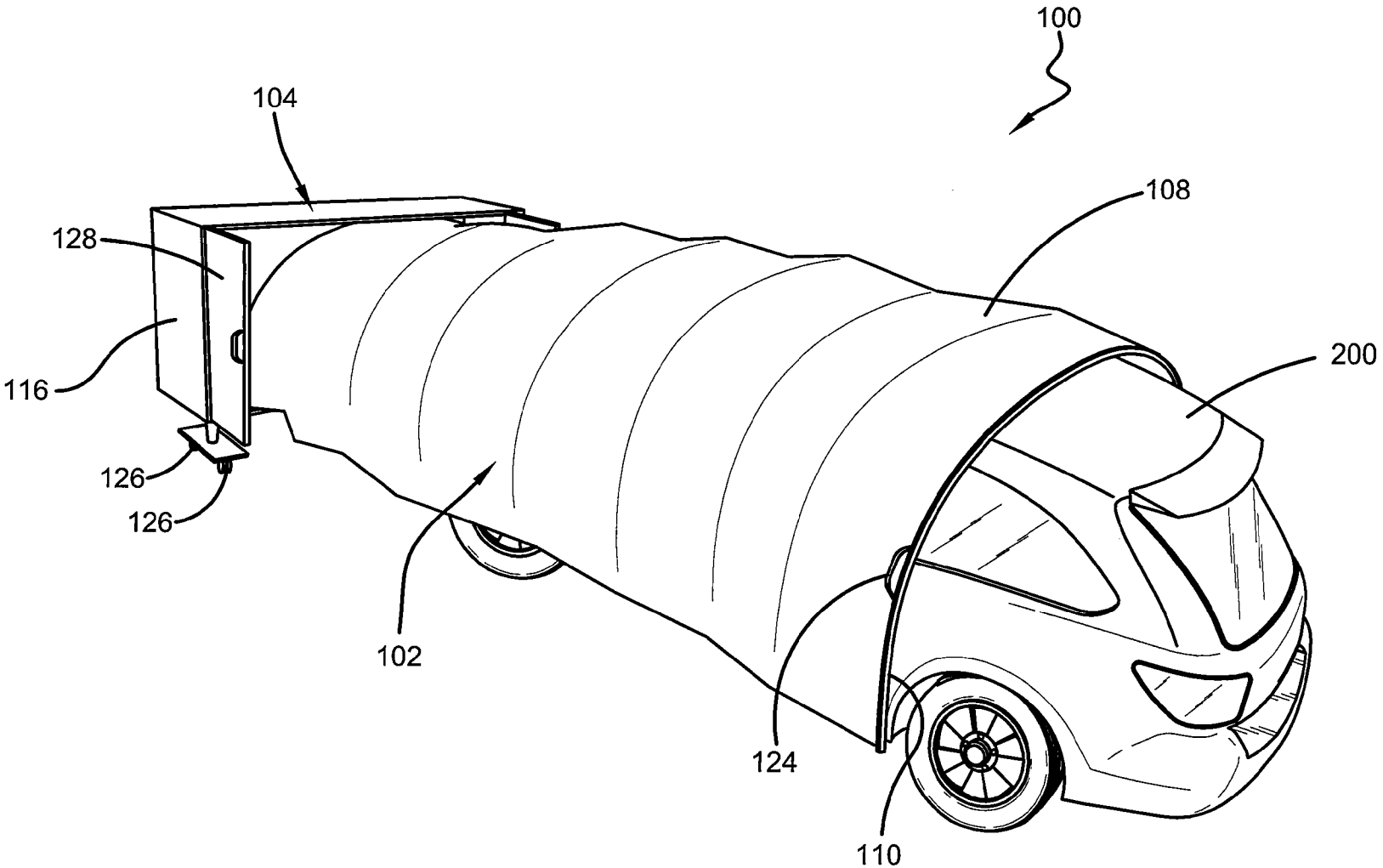
FIG. 3 illustrates a perspective view of the temporary garage device in accordance with the disclosed architecture.

Referring initially to the drawings, FIGS. 1-3 illustrate the temporary garage device 100 that allows users to easily cover and protect their vehicle from harmful elements and other debris. The temporary garage device 100 comprises a protective cover component 102 and a storage component 104 for storing the protective cover component 102. The protective cover component 102 comprises an interior surface 106 and an exterior surface 108.

Typically, the protective cover component 102 is arc-shaped, however any other suitable shape can be used as is known in the art without affecting the overall concept of the invention, provided that the same is capable of substantially covering the vehicle. The protective cover component 102 would generally be constructed of rip-stop nylon, canvas, polyvinyl chloride (PVC), Kevlar®, or any other similar lightweight, weatherproof, flexible material, etc., though any other suitable material may be used to manufacture the protective cover component 102 as is known in the art without affecting the overall concept of the invention. The protective cover component 102 can also comprise a variety of colors and designs to suit user and manufacturing preference. When fully deployed, the protective cover component 102 is approximately between 15 and 18 feet long as measured from opposing ends 110, and approximately between 6 and 9 feet in diameter (or width).

Typically, the protective cover component 102 is positioned in an arc-shape via a plurality of beams 112 secured to the interior surface 106 of the protective cover component 102 to form a semi-rigid skeletal structure (or configuration). The beams 112 provide strength to the structure and keep the protective cover component 102 clear of the top of the vehicle. The beams 112 would generally be secured to the interior surface 106 of the protective cover component 102 via stitching, gluing, straps, fasteners, etc., or any other suitable securing means as is known in the art without affecting the overall concept of the invention. Further, the beams 112 would generally be constructed of plastic, aluminum, or wood, etc., though any other suitable flexible material may be used to manufacture the beams 112 as is known in the art. Further, the beams 112 can be encapsulated in nylon material, or any other suitable material as is known in the art, so as not to damage the vehicle. Typically, the beams 112 are positioned at approximately equally spaced intervals along the length of the protective cover component 102 to form the semi-rigid skeletal structure. Specifically, the beams 112 are positioned along the length of the protective cover component 102 to form a tubular (or cylindrical) configuration that acts to cover or surround a vehicle.

The protective cover component 102 further comprises a plurality of securing components (magnets 400 as shown in FIG. 4) positioned on a bottom edge of the protective cover component 102 to secure the protective cover component 102 to the vehicle 200. Typically, the securing component comprise magnets 400, but any other suitable securing means can be used as is known in the art without affecting the overall concept of the invention. The magnets 400 act to secure the protective cover component 102 to the vehicle 200 by clinging to (via magnetic attraction) the sides and/or underneath the vehicle 200 once the protective cover component 102 is deployed. In moderate weather, the protective cover component 102 needs only to be secured via the magnets 400, which are typically located toward the end of the protective cover component 102, and which would secure at the end or front of the vehicle depending on how the vehicle is parked. In severe weather, the temporary garage device 100 should not be used.

The temporary garage device 100 further comprises a storage component 104 for storing the protective cover component 102. The storage component 104 comprises an interior space 114 and an exterior surface 116. Typically, the storage component 104 is rectangular in shape, however any other suitable shape can be used as is known in the art without affecting the overall concept of the invention. The storage component 104 would generally be constructed of a weatherproof material, such as aluminum, plastic, or stainless steel, etc., though any other suitable material may be used to manufacture the storage component 104 as is known in the art without affecting the overall concept of the invention. The storage component 104 can also comprise a variety of colors and designs to suit user and manufacturing preference. The storage component 104 is approximately between 6 and 9 feet wide as measured from opposing sides 118, and approximately between 3 and 7 feet in height as measured from top and bottom ends 120, and approximately between 4 and 6 feet in length as measured from the front surface 122 to the back surface (not shown).

Typically, the storage component 104 is configured to store the protective cover component 102 within the interior of the storage component 104, and the protective cover component 102 is repositionable between a stored position and a deployed position. Specifically, in the stored position, the protective cover component 102 collapses in an accordion style for storage in the storage component 104. The beams 112 positioned along the length of the protective cover component 102 act to support the protective cover component 102 as the cover component 102 is collapsed (or compacted or folded) in an accordion style and positioned within the interior of the storage component 104 (as shown in FIG. 1). Then in the deployed position, the protective cover component 102 can be extended outward from the storage component 104 to cover a vehicle 200 when needed. Specifically, the arc-shaped protective cover component 102 linearly extends outward from the storage component 104 in a semi-tubular (or semi-cylindrical) configuration to cover the vehicle 200 (as shown in FIGS. 2-3), but an end of the protective cover component 102 remains secured to the interior of the storage component 104. Additionally, the storage component 104 comprises doors 128 that secure the protective cover component 102 within the interior of the storage component 104. The doors are typically swing open type doors, however any other suitable door-like structure could used, such as roll-up doors, etc., as is known in the art.

Additionally, a user may manipulate the protective cover component 102 via collapsing struts, folding struts, or without the use of struts, or by any other suitable means as is known in the art.

Further, the interior of the storage component 104 comprises hooks (not shown) or any other suitable securing means as is known in the art to secure the protective cover component 102 in an upright position within the interior of the storage component 104, to make it easier for a single user to linearly extend out the protective cover component 102 from the storage component 104 by himself or herself. Additionally, the protective cover component 102 can comprise a pair of handles 124 secured to either side (or both sides) of the arc-shaped protective cover component 102, or secured to at least one of the beams 112. The pair of handles 124 allows a user to pull the protective cover component 102 linearly outward from the storage component 104. Typically, the handles 124 are secured to the protective cover component 102 via stitching, gluing, fasteners, etc., or any other suitable securing means as is known in the art without affecting the overall concept of the invention.

The storage component 104 further comprises a plurality of wheels 126 secured to a bottom side 120. The wheels can be secured to the storage component 104 via gluing, fasteners, welding, etc., or any other suitable securing means as is known in the art. The wheels 126 are positioned on the bottom of the storage component 104 to allow the storage component 104 to move and for ease in transport. Typically, the plurality of wheels 126 comprise brakes/stops to prevent the storage component 104 from moving while in use. Thus, once the storage component 104 is rolled via the plurality of wheels 126 to the desired location, the user can then engage the brakes to prevent the storage component 104 from further movement.

Figures 4A, 4B:
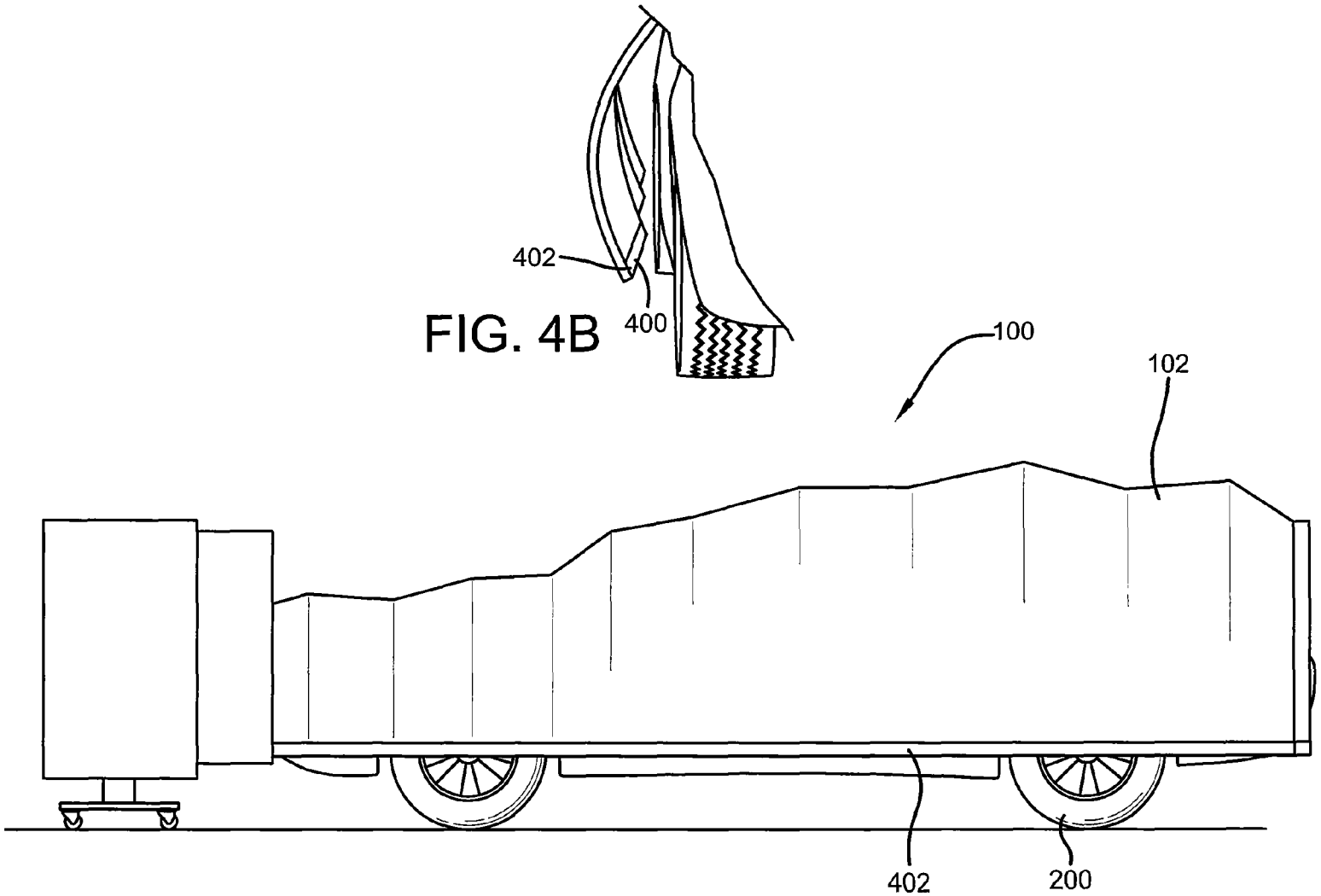
FIG. 4A illustrates a perspective view of the temporary garage device with magnets securing the device to a vehicle in accordance with the disclosed architecture.
FIG. 4B illustrates a perspective view of the magnets secured to the temporary garage device in accordance with the disclosed architecture.

FIGS. 4A and 4B illustrate the temporary garage device 100 with magnets 400 securing the protective cover component 102 to a vehicle 200. As stated supra, the protective cover component 102 further comprises a plurality of securing components (magnets 400 as shown in FIG. 4B) positioned on a bottom edge 402 of the protective cover component 102 to secure the protective cover component 102 to the vehicle 200. Typically, the securing components comprise magnets 400, but any other suitable securing means can be used as is known in the art without affecting the overall concept of the invention. The magnets 400 act to secure the protective cover component 102 to the vehicle 200 by clinging to (via magnetic attraction) the sides and/or underneath the vehicle 200 once the protective cover component 102 is in place (as shown in the FIG. 4A). In moderate weather, the protective cover component 102 needs only to be secured via the magnets 400, which are typically located toward the end of the protective cover component 102, and which would secure at the end or front of the vehicle depending on how the vehicle is parked. In severe weather, the temporary garage device 100 should not be used.

Figure 5:
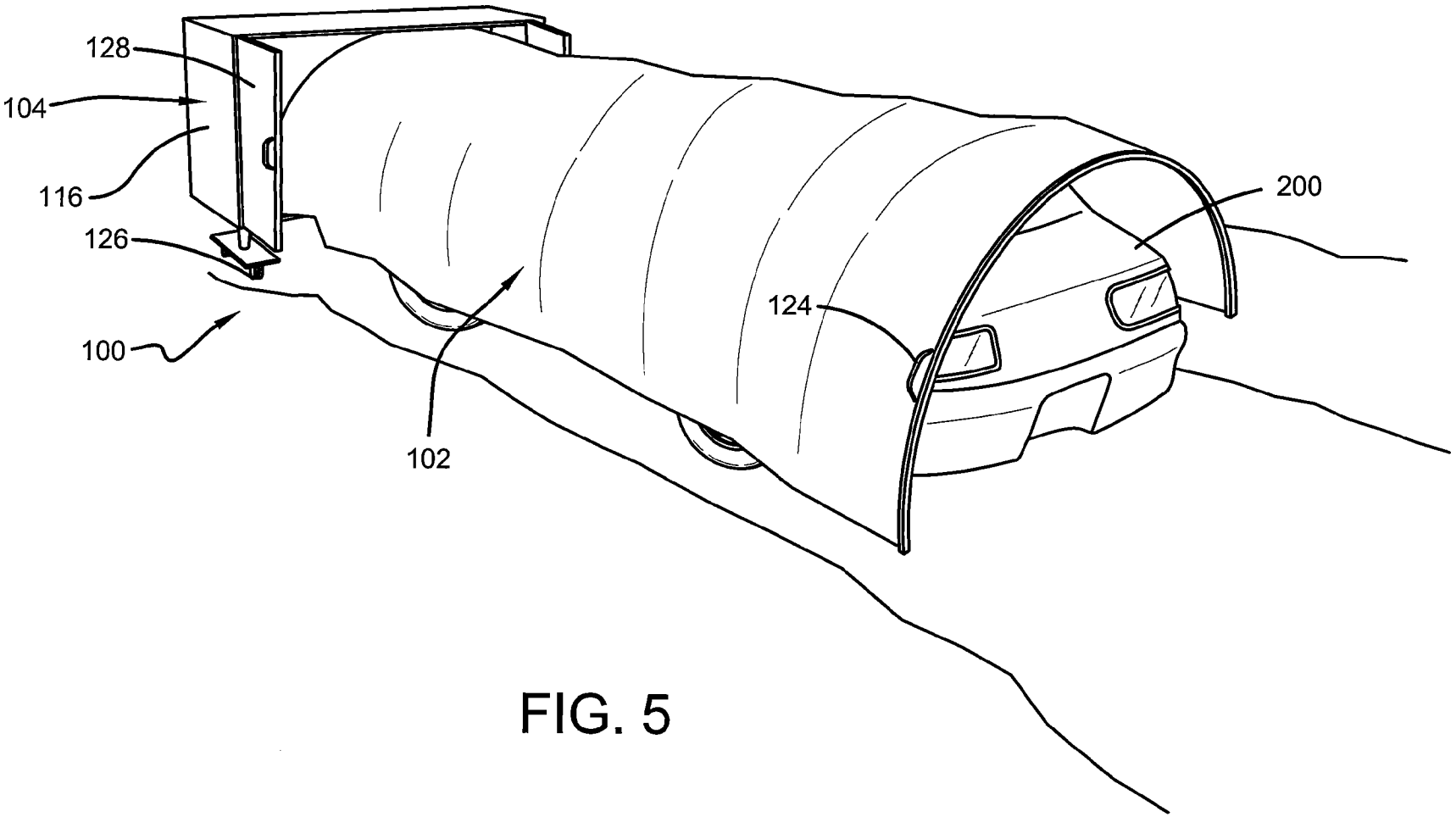
FIG. 5 illustrates a perspective view of the temporary garage device in use in accordance with the disclosed architecture.

FIG. 5 illustrates the temporary garage device 100 in use. In operation, a user (not shown) would choose the color and/or specific design of the temporary garage device 100 that meets their needs and/or wants, and depending on the size and shape of the vehicle 200 they want to protect. The user would then roll the storage component 104 via its wheels 126 to the desired location and then would engage the brakes of the wheels 126, such that the storage component 104 is prevented from further movement. The user would then position their vehicle 200 in front of the doors 128 of the storage component 104. The user would then open the doors 128 of the storage component 104 and grasp the handles 124 of the protective cover component 102. Using the handles 124, the user would then pull the protective cover component 102 out of the storage component 104. Specifically, the user pulls the protective cover component 102 such that it extends linearly outward from the storage component 104 in a tubular (or cylindrical) configuration to cover the vehicle 200.

Once the vehicle 200 is covered with the protective cover component 102, the user would then secure the protective cover component 102 over the vehicle 200 via magnets positioned on the bottom edges of the protective cover component 102. The magnets cling to the sides and or underneath the vehicle 200, securing the protective cover component 102 in place. Once the user is done using the protective cover component 102, the user disengages the magnets and retracts the protective cover component 102 back into the storage component 104. The user collapses the protective cover component 102 in an accordion style, back within the interior of the storage component 104 and closes the doors 128, securing the protective cover component 102 within the storage component 104. The user can then release the wheel brakes and transport the storage component 104 to a desired location for storage. Thus, the temporary garage device 100 protects vehicles 200 from harmful elements and harsh weather conditions.

Furthermore, it is also contemplated that the protective cover component 102 can be secured to a house or other structure, and the vehicle 200 could be parked next to it, either head on or sideways, such that the protective cover component 102 can then be pulled over the vehicle 200 from front to back, or pulled over the vehicle 200 from side to side, depending on how the vehicle 200 is parked under the protective cover component 102. Additionally, the protective cover component 102 could be secured to a ground structure that a user would drive the vehicle 200 onto. The protective cover component 102 can then be pulled over the vehicle 200, or the protective cover component 102 can be split and secured to either side of the vehicle 200 and then pulled up and secured together at the top of the vehicle 200.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A temporary garage device, comprising:

a protective cover component comprising an interior surface and an exterior surface; and a storage component for storing the protective cover component when not in use;

wherein the protective cover component is positioned in an arc-shape via a plurality of beams secured to the interior surface of the protective cover component to form a semi-rigid skeletal structure; and wherein the protective cover component is repositionable between a stored position and a deployed position; and wherein the storage component comprises a plurality of wheels secured to a bottom side; and wherein the protective cover component further comprises a plurality of magnets positioned on a bottom edge of the protective cover component to secure the bottom edge of the protective cover component underneath a vehicle when the protective cover component is in a deployed position.

2. The temporary garage device of claim 1, wherein in the stored position the protective cover component collapses in an accordion style for storage in the storage component.

3. The temporary garage device of claim 2, wherein in the deployed position the protective cover component linearly extends outward from the storage component in a semi-tubular configuration to cover a vehicle.

4. The temporary garage device of claim 3, further comprising a pair of handles secured to either side of the protective cover component, which allows a user to pull the protective cover component linearly outward from the storage component.

5. The temporary garage device of claim 1, wherein the plurality of wheels comprise brakes.

6. The temporary garage device of claim 1, wherein the protective cover component is manufactured of nylon.

7. The temporary garage device of claim 1, wherein the storage component is manufactured of a weather-proof material, such as aluminum, plastic, or stainless steel.

8. A temporary garage device, comprising:

a protective cover component comprising an interior surface and an exterior surface; and a storage component for storing the protective cover component when not in use;

wherein the protective cover component is positioned in an arc-shape via a plurality of beams secured to the interior surface of the protective cover component to form a semi-rigid skeletal structure; and wherein in a stored position the protective cover component collapses in an accordion style for storage in the storage component; and wherein the storage component comprises a plurality of wheels secured to a bottom side; and wherein the protective cover component further comprises a plurality of magnets positioned on a bottom edge of the protective cover component to secure the bottom edge of the protective cover component underneath a vehicle when the protective cover component is in a deployed position.

9. The temporary garage device of claim 8, wherein in the deployed position the protective cover component linearly extends outward from the storage component in a semi-tubular configuration to cover a vehicle.

10. The temporary garage device of claim 9, further comprising a pair of handles secured to either side of the protective cover component, which allows a user to pull the protective cover component linearly outward from the storage component.

11. The temporary garage device of claim 8, wherein the plurality of wheels comprise brakes.

12. A temporary garage device, comprising:

a protective cover component comprising an interior surface and an exterior surface; and a storage component comprising a plurality of wheels and brakes secured to a bottom side;

wherein the protective cover component is positioned in an arc-shape via a plurality of beams secured to the interior surface of the protective cover component to form a semi-rigid skeletal structure; and wherein in a stored position the protective cover component collapses in an accordion style for storage in the storage component, and in a deployed position the protective cover component linearly extends outward from the storage component in a semi-tubular configuration to cover a vehicle; and wherein the protective cover component further comprises a plurality of magnets positioned on a bottom edge of the protective cover component to secure the bottom edge of the protective cover component underneath a vehicle when the protective cover component is in the deployed position.

13. The temporary garage device of claim 12, further comprising a pair of handles secured to either side of the protective cover component, which allows a user to pull the protective cover component linearly outward from the storage component.

* * * * *